US005780398A

United States Patent [19]

King et al.

[11] Patent Number: 5,780,398

[45] Date of Patent: Jul. 14, 1998

[54] HIGH OVERBASED ALKYLOXY AROMATIC SULFONATE-CARBOXYLATES AS LUBE OIL ADDITIVES

[75] Inventors: William F. King, Novato; Richard J. Nelson, Pinole; Robert H. Wollenberg, Orinda; Steven G. Lockett, San Rafael, all of Calif.

[73] Assignee: Chevron Chemical Company, San Ramon, Calif.

[21] Appl. No.: 900,061

[22] Filed: Jul. 24, 1997

Related U.S. Application Data

[63] Continuation of Ser. No. 775,065, Dec. 27, 1996, abandoned.

[51] Int. Cl.[6] ..... C10M 159/24; C10M 159/22

[52] U.S. Cl. ..... 508/401

[58] Field of Search ..... 508/401, 402, 508/460

[56] References Cited

U.S. PATENT DOCUMENTS

| | | | |
|---|---|---|---|
| 3,523,898 | 8/1970 | De Vault | 252/33 |
| 4,751,010 | 6/1988 | Leone et al. | 252/33 |
| 4,965,003 | 10/1990 | Schlicht | 508/186 |
| 4,965,004 | 10/1990 | Schlicht et al. | 508/186 |
| 5,037,656 | 8/1991 | King | 508/401 |
| 5,281,345 | 1/1994 | Crawford et al. | 508/460 |
| 5,330,663 | 7/1994 | Wollenberg et al. | 252/18 |
| 5,330,664 | 7/1994 | Wollenberg et al. | 252/18 |
| 5,433,871 | 7/1995 | O'Connor et al. | 508/460 |
| 5,437,803 | 8/1995 | Cane et al. | 508/460 |

FOREIGN PATENT DOCUMENTS

| | | | |
|---|---|---|---|
| 351053 | 1/1990 | European Pat. Off. . | |
| 1 332 473 | 10/1973 | United Kingdom | C07C 143/46 |
| 1 372 532 | 10/1974 | United Kingdom | C07C 143/46 |

*Primary Examiner*—Jerry D. Johnson
*Attorney, Agent, or Firm*—Ernest A. Schaal

[57] ABSTRACT

An additive useful in a marine lubricating oil is produced by reacting at elevated temperatures in the presence of at least one light hydrocarbon solvent and promoter: an alkyl oxy aromatic sulfonate; an alkaline earth metal base; carbon dioxide; and an acid component, such as carboxylic acid, an acid anhydride, an acid choride, or ester thereof. If the alkyl oxy aromatic sulfonate is in the acidic form, then the acid component is in the acidic form. If the alkyl oxy aromatic sulfonate is in the neutralized form, then the acid component is in the neutralized form. If the alkyl oxy aromatic sulfonate is in the overbased form, then the acid component is either in the acidic form or in the neutralized form.

24 Claims, No Drawings

HIGH OVERBASED ALKYLOXY AROMATIC SULFONATE-CARBOXYLATES AS LUBE OIL ADDITIVES

This is a continuation of application Ser. No. 08775,065, filled Dec. 27, 1996, now abandoned.

The present invention relates to an additive especially useful in a marine lubricating oil.

BACKGROUND OF THE INVENTION

Additive concentrates of overbased alkyl aromatic sulfonates and overbased alkyl oxy aromatic sulfonates are useful in lube oil. Preferably, such concentrates should have a high TBN without high petroleum ether insolubles at an acceptable viscosity.

U.S. Pat. No. 3,523,898 teaches that overbased alkyl phenol sulfonic acids are useful as detergents in lubricating oils. The TBN appears to be limited to 150 or less.

British Patent No. 1,372,532 teaches that mixtures of overbased, alkyl hydroxy benzene sulfonates and alkylsalicylic acids are useful in lubricating oils. The TBN appears to be about 200.

British Patent No. 1,332,473 teaches that overbased, alkyl hydroxy benzene sulfonates are useful as an oil-soluble dispersant in lubricating oils. The TBN appears to be about 400, with a very high base ratio.

U.S. Pat. No. 4,751,010 teaches that partial sulfonation of alkylphenol results in the formation of an alkyl hydroxy benzene sulfonate that can be overbased using sulfurization and carbonation. The TBN appears to be in the range of from 200 to 250.

U.S. Pat. Nos. 5,330,663 and 5,330,664 teach overbased alkyl oxy aromatic sulfonates that have alkyl groups derived from substantially straight-chained olefins that are either internal or alpha.

European Patent Application No. 0 351 053 A2 discloses a process for producing a lubricating oil additive concentrate by reacting at elevated temperatures a calcium hydrocarbyl-substituted sulfonate; an alkaline earth metal base; a defined alcohol, ketone, carboxylic acid ester, or ether; a lubricating oil; carbon dioxide; a defined carboxylic acid or derivative; and either an inorganic halide, ammonium alkanoate, or alkyl ammonium formate or alkanoate.

While some of the products of the cited art gave high TBN, none of them gave high TBN without high petroleum ether insolubles at an acceptable viscosity.

U.S. Pat. Nos. 3,523,898; 4,751,010; 5,330,663; and 5,330,664 are all hereby incorporated by reference for all purposes.

SUMMARY OF THE INVENTION

The present invention provides a process for the production of a lubricating oil additive that, when used in a concentrate or in a lubricating oil, gives high TBN without high petroleum ether insolubles at an acceptable viscosity.

The process of the present invention comprises reacting at elevated temperatures in the presence of at least one light hydrocarbon solvent and promoter: an alkyl oxy aromatic sulfonate, an alkaline earth metal base, carbon dioxide, and an acid component selected from the group consisting of a carboxylic acid, an acid anhydride, an acid choride, and ester thereof.

The oxy of the alkyl oxy aromatic sulfonate is selected from the group consisting of hydroxy, methoxy, ethoxy, propoxy, butoxy, pentoxy, and hexoxy. Preferably, the alkyl group of the alkyl oxy aromatic sulfonate has from eighteen to thirty carbon atoms per alkyl group, more preferably from twenty to twenty four carbon atoms per alkyl group. Preferably, between 40 weight % and 80 weight % the alkyl groups of the alkyl oxy aromatic sulfonate are attached at the 4-position and higher positions of the alkyl groups. Preferably, the oxy group is hydroxy, and the aromatic group is benzene.

Preferably, the alkaline earth metal is calcium.

The acid component has a molecular weight of less than 500 and has the following structure:

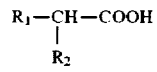

wherein $R_1$ is a $C_{10}$ to $C_{24}$ alkyl or alkenyl group, wherein $R_2$ is hydrogen, a $C_1$ to $C_4$ alkyl group, or a $CH_2COOH$ group, and the acid component provides from 2 to 40 weight % of the additive.

If the alkyl oxy aromatic sulfonate is in the acidic form, then the acid component is in the acidic form. If the alkyl oxy aromatic sulfonate is in the neutralized form, then the acid component is in the neutralized form. If the alkyl oxy aromatic sulfonate is overbased, then the acid component is either in the acidic form or in the neutralized form.

Preferably, the acid component is a carboxylic acid, more preferably stearic acid. Preferably, the acid component provides from 15 to 25 weight % of the sum of the acid component and alkyl oxy aromatic sulfonate and the base ratio of calcium carbonate to calcium sulfonate is from 5:1 to 30:1, more preferably from 17:1 to 20:1.

Preferably, the reaction occurs at atmospheric pressure and temperatures of from 90° to 120° F.

The additive can be used in an additive concentrate, having a TBN of at least 200, and having from 20 to 50 weight % a base oil of lubricating viscosity and from 50 to 80 weight % of the additive. Preferably, the TBN of the additive concentrate is between 300 and 500. The additive concentrate can be used in a marine lubricating oil having a major amount of a base oil of lubricating viscosity; and a minor amount of the additive concentrate.

DETAILED DESCRIPTION OF THE INVENTION

In its broadest aspect, the present invention involves a process for the production of an additive useful in an additive concentrate or in a marine lubricating oil. That process comprises reacting at elevated temperatures, in the presence of at least one light hydrocarbon solvent and promoter, an alkyl oxy aromatic sulfonate, an alkaline earth metal base, carbon dioxide, and an acid component. The form of the alkyl oxy aromatic sulfonate determines the form of the acid component. This additive, when used in a concentrate or in a lubricating oil, gives high TBN, without high petroleum ether insolubles, at an acceptable viscosity.

By "acidic form," we mean that a material is still an acid.

By "neutralized form," we mean that an acidic form of a material has been treated with a base to the point that it is no longer acidic.

By "overbased form," we mean that a neutralized form has been treated with carbon dioxide in the presence of additional base and a light hydrocarbon solvent and a promoter to make it more basic.

By "TBN," we mean "Total Base Number," which refers to the amount of base equivalent to one milligram of KOH in one gram of additive. Thus, higher TBN numbers reflect more alkaline products and therefore a greater alkalinity reserve. The Total Base Number for an additive composition is readily determined by ASTM test method D664 or other equivalent methods.

By "Calcium as Sulfonate value," we mean the weight percent of sulfonate, when measured as if it were calcium sulfonate, regardless of its form (acidic, neutral, or overbased).

The Alkyl Oxy Aromatic Sulfonate

The alkyl oxy aromatic sulfonate can be in the acidic form (alkyl oxy aromatic sulfonic acid), in the neutralized form, or in the overbased form. The oxy group can be either hydroxy, methoxy, ethoxy, propoxy, butoxy, pentoxy, or hexoxy. Preferably, it is hydroxy. Preferably, the aromatic group is benzene.

Preferably, the alkyl group of the overbased, alkyl oxy aromatic sulfonate has from eighteen to thirty carbon atoms per alkyl group. More preferably, the alkyl group has from twenty to twenty four carbon atoms per alkyl group.

The alkyl oxy aromatic sulfonate of the present invention can be produced by alkylating an oxy benzene with an olefin to produce an alkyl oxy benzene, and sulfonating the alkyl oxy benzene to produce an alkyl oxy benzene sulfonic acid. Preferably, the olefin used in the alkylation is an internal olefin, but alpha olefins can be used. Preferably, the olefin is straight-chained, but it can be branched. The alkyl oxy benzene can then be neutralized or overbased, using an alkaline earth metal base.

The processes of alkylating an alkyl oxy benzene with an olefin to produce an alkyl oxy benzene, and sulfonating the alkyl oxy benzene to produce an alkyl oxy benzene sulfonic acid are both discussed in detail in U.S. Pat. Nos. 5,330,663 and 5,330,664, which have been incorporated by reference for all purposes. Our alkylation and sulfonation processes differ only in the olefins used and reaction time. In our batch alkylation reaction, we need only about six to eight hours. The preferred sulfonation process is a falling film process using a charge mole ratio of sulfur trioxide to alkylphenol of 1.1:1 and a reaction temperature in the range of from 70° to 100° C., followed by immediate neutralization. Preferably, the neutralization is done in a slurry of xylenes, methanol, and $Ca(OH)_2$.

The Acid Component

The acid component is selected from the group consisting of a carboxylic acid, an acid anhydride, an acid choride, and an ester thereof. The acid component has a molecular weight of less than 500 and has the following structure:

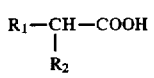

wherein $R_1$ is a $C_{10}$ to $C_{24}$ alkyl or alkenyl group, and wherein $R_2$ is hydrogen, a $C_1$ to $C_4$ alkyl group, or a $CH_2COOH$ group. The acid component provides from 2 weight % to 40 weight % of the additive, preferably from 15 weight % to 25 weight % of the additive.

Preferably, the acid component is a carboxylic acid, more preferably stearic acid.

Preferably, the base ratio of calcium carbonate to calcium sulfonate is from 5:1 to 30:1, more preferably from 17:1 to 20:1

The neutralization of the acid component can done in a slurry of xylenes, methanol, and $Ca(OH)_2$.

The Solvent

The solvent can be any light hydrocarbon that would solubilize the reaction mixture. Preferably, the solvent is xylene.

The Promoter

The promoter can be any material that enhances carbonation. Preferably, he promoter is a $C_1$ to $C_6$ monoalcohol. More preferably, it is methanol.

The Alkaline Earth Metal Base

Preferably, the alkaline earth metal is calcium. The alkaline earth metal base could be calcium oxide or calcium hydroxide.

The Process

The material to be overbased may be prepared using one of three methods:

1. The neutral forms of the alkyl oxy aromatic sulfonic acid and the acid component may be mixed prior to the overbasing step.

The neutral form of the alkyl oxy aromatic sulfonic acid may be prepared from a neutralization slurry made up of 51.5 weight % of the sulfonic acid (having a Calcium as Sulfonate value of at least 3.80%), 38.6 weight % xylenes, 5.5 weight % methanol, and 4.4 weight % $Ca(OH)_2$ by first mixing the xylenes, methanol, and $Ca(OH)_2$ and then adding the sulfonic acid.

The neutral form of the acid component may be prepared from the neutralization slurry of 80.5 weight % xylenes, 16.2 weight % of the acid component, 1.0 weight % methanol, and 2.3 weight % $Ca(OH)_2$ by first dissolving the acid component in the xylenes and then adding the methanol and $Ca(OH)_2$.

2. The acid forms of the alkyl oxy aromatic sulfonic acid (with a Calcium as Sulfonate value of at least 3.80%) and the acid component may be mixed and then neutralized prior to overbasing. The acid mixture may be neutralized by preparing a slurry made up of 51.5 weight % of the acid mixture, 37.4 weight % xylenes, 5.5 weight % methanol, and 5.6 weight % $Ca(OH)_2$ by first mixing the xylenes, methanol, and $Ca(OH)_2$, and then adding the acid mixture.

3. The acidic form of the acid component may be mixed with the neutral or overbased form of the alkyl oxy aromatic sulfonic acid prior to overbasing. In this case, a neutralization slurry of xylenes, methanol, and $Ca(OH)_2$ may be necessary prior to carbonation to ensure neutralization of the acid component before carbonation begins.

In one embodiment, overbasing can be carried out by using a slurry comprising two thirds of the acid or neutral components described above, mixed with one third of the $Ca(OH)_2$ slurry necessary for carbonation. Carbonation begins, and at approximately 5% of the carbon dioxide charge, the remaining one third of the acid or neutral component is added. At approximately 10% of the carbon dioxide charge, the remaining two thirds of the $Ca(OH)_2$ slurry for carbonation is added. At 80% of the carbon dioxide charge, an additional $Ca(OH)_2$ slurry is added to build additional base. Total carbonation time is approximately 210 minutes with the rate of carbonation being reduced over time.

After carbonation, the material is stripped to 200° F. over two hours. It is then further stripped to 270° F. over thirty minutes. At 270° F., 150 Neutral oil is added and the mixture filtered to remove the process solids. The filtrate is then stripped to 400° F. at 40 mm Hg vacuum.

The Lubricating Oil Product

The additive compositions produced by the process of this invention are useful lubricating oil additives imparting detergency and dispersency properties when added to the lubricating oil composition employed in the crank case of an internal combustion engine. Such lubricating oil compositions comprise a major amount of base oil of lubricating viscosity; and a minor amount of oil-soluble, highly overbased, alkyl oxy aromatic sulfonate additive compositions. These lubricating oil compositions are useful in diesel engines, gasoline engines, as well as in marine engines.

Such lubricating oil compositions employ a finished lubricating base oil of lubricating viscosity, which may be single or multigrade. Multigrade lubricating base oils are prepared by adding viscosity index (VI) improvers. Typical viscosity index improvers are polyalkyl methacrylates, ethylene and propylene copolymers, styrene-diene copolymers, and the like.

The lubricating base oils used in such compositions may be mineral oils or synthetic oils of viscosity suitable for use in the crank case of an internal combustion engine such as gasoline engines and diesel engines, which include marine engines. Crank case lubricating oils ordinarily have a viscosity of about 1300 cSt at 0° F. to 24 cSt at 210° F. (99° C.). The lubricating base oils may be derived from synthetic or natural sources. Mineral oils for use as the base oil in the invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of α-olefins having the proper viscosity. Especially useful are the hydrogenated liquid oligomers of $C_6$ to $C_{12}$ α-olefins, such as 1-decene trimer. Likewise, alkylbenzenes of proper viscosity, such as didodecyl benzene, can be used. Useful synthetic esters include esters of both monocarboxylic acids and polycarboxylic acids as well as monohydroxy alkenols and polyols. Typical examples are didodecyl adipate, pentaerythriol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight % hydrogenated 1-decene trimer with 75 to 90 weight % 150 SUS (100° F.) mineral oil gives an excellent lubricating base oil.

In one embodiment, the lubricating oil also has an ashless dispersant and a zinc dialkyldithiophosphate.

In another embodiment, the lubricating oil also has a detergent selected from the group consisting of metal phenates, metal sulfonates, and metal salicylates.

Other additives that may be present in the formulation include rust inhibitors, foam inhibitors, corrosion inhibitors, metal deactivators, pour point depressants, anti-oxidants, and a variety of other well-known additives More specifically, the following additive components are examples of components that can be favorably employed in combination with the overbased, alkyl oxy aromatic sulfonate of the present invention:

(1) Metallic detergents: overbased sulfurized alkylphenates, overbased sulfonates, and overbased salicylates;

(2) Ashless dispersants: alkenyl succinimides, alkenyl succinimides modified with other organic compounds, and alkenyl succinimides modified with boric acid, and alkenyl succinic esters;

(3) Oxidation inhibitors:

1) Phenol type phenolic oxidation inhibitors: 4,4'-methylenebis (2,6-di-tert-butylphenol), 4,4'-bis(2,6-di-tert-butylphenbl), 4,4'-bis(2-methyl-6-tert-butylphenol), 2,2'-(methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4ethylphenol, 2,4-dimethyl-6-tert-butyl-phenol, 2,6-di-tert-α-dimethylamino-p-cresol, 2,6-di-tert-4-(N,N'dimethylaminomethylphenol), 4,4'-thiobis(2-methyl6-tert-butylphenol), 2,2'-thiobis (4-methyl-6-tert-butylphenol), bis(3-methyl-4-hydroxy-5-tert-butylbenzyl)-sulfide, and bis (3,5-di-tert-butyl-4-hydroxybenzyl)-sulfide;

2) Diphenylamine type oxidation inhibitors: alkylated diphenylamine, phenyl-α-naphthylamine, and alkylated α-naphthylamine;

3) Other types: metal dithiocarbamate (e.g., zinc dithiocarbamate), and methylenebis (dibutyldithiocarbamate).

(4) Rust inhibitors (Anti-rust agents)

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate;

2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester;

(5) Demulsifiers: addition product of alkylphenol and ethyleneoxide, polyoxyethylene alkyl ether, and polyoxyethylene sorbityl ester;

(6) Extreme pressure agents (EP agents): zinc dialkyldithiophosphate (primary alkyl type & secondary alkyl type), sulfurized oils, diphenyl sulfide, methyl trichlorostearate, chlorinated naphthalene, benzyl iodide, fluoroalkylpolysiloxane, and lead naphthenate;

(7) Friction modifiers: fatty alcohol, fatty acid, amine, borated ester, and other esters;

(8) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound;

(9) Viscosity index improvers: polymethacrylate type polymers, ethylenepropylene copolymers, styrene-isoprene copolymers, hydrated styrene-isoprene copolymers, polyisobutylene, and dispersant type viscosity index improvers;

(10) Pour point depressants: polymethyl methacrylate.

The Additive Concentrate

The additive compositions produced by the process of the present invention can be formed into an additive concentrate having a TBN of at least 200. That additive concentrate can have from 50 to 80 weight % of the additive and from 20 to 50 weight % a base oil of lubricating viscosity. Preferably, the TBN of the additive concentrate is between 300 and 500.

The base oil of lubricating viscosity can be added to the reaction mixture prior to the formation of the additive, or it can be added to the resulting additive, or part of it can be added to the reaction mixture prior to the formation of the additive and the remainder added to the resulting additive. Preferably, the base oil of lubricating viscosity is added to the additive after it is formed.

EXAMPLES

The invention will be further illustrated by following examples, which set forth particularly advantageous method embodiments. While the Examples are provided to illustrate the present invention, they are not intended to limit it.

Comparative Example A

Overbased Alkyl Hydroxy Benzene Sulfonate

A. Sulfonation of Alkylated Hydroxy Benzene

The alkylated hydroxy benzene was sulfonated using a falling film reactor. Reaction conditions were as follows:

| | |
|---|---|
| Feed rate of alkyl hydroxy benzene | 4.26 grams/minute |
| Charge mole ratio of sulfur trioxide to alkyl hydroxy benzene | 0.96:1 |
| Air to sulfur trioxide ratio | 4:1 |
| Reaction temperature | 90° C. |

Cyclohexylamine titration analysis for this product indicates that a Calcium as Sulfonate value of 3.88 weight % was obtained.

B. Neutralization 403 grams of alkyl hydroxy benzene sulfonic acids produced above were immediately neutralized in a stirred beaker containing 302 grams xylenes, 43 grams methanol, and 34 grams calcium hydroxide. Neutralization was completed by heating for half an hour at 100° F.

C. Overbasing 450 grams of xylenes, 99 grams of methanol, and 163.4 grams of calcium hydroxide were added to a reactor and stirred for five minutes. A slurry made up of 201.5 grams of alkyl hydroxy benzene sulfonic acid having a Calcium as Sulfonate value of 3.80 weight %, 151 grams xylenes, 21.5 grams methanol, and 17 grams calcium hydroxide, was then added to the reactor and stirred for twenty minutes. The slurry was heated to 90° F. during the twenty minute stir period. 88.4 grams of carbon dioxide was charged to the reactor over 144 minutes. The rate of addition of the carbon dioxide was gradually reduced from 0.76 grams/minute to 0.25 grams/minute over the carbonation period. At 75% of the carbon dioxide charge, a second slurry made up of 151 grams xylenes, 21.5 grams methanol, and 17 grams calcium hydroxide was added. At 80% of the carbon dioxide charge, a slurry made up of 56 grams xylenes, 7 grams methanol, and 38.0 grams calcium hydroxide was added.

At the end of carbonation, the reactor was equipped with a condenser for stripping, and the temperature was ramped to 200° F. over two hours. At 200° F., the temperature was ramped to 270° F. over thirty minutes. At 270° F., 215 grams of 100 Neutral oil was added and the entire batch was then filtered through a Buchner filter. The filtrate was then stripped to 400° F. at 40 mm Hg vacuum. The base number was then measured with a resulting number of 336. An additional 92 grams of 100 Neutral oil was added to adjust the base number to 300.

The final product had a viscosity of 165 cSt at 100° C. at a total base number of 300. It had 49.33% of the alkyl groups of the sulfonate attached at the 4-position and higher positions of the alkyl groups.

EXAMPLE 1

Neutralized Alkyl Hydroxy Benzene Sulfonate Neutralize Stearic Acid

A. Sulfonation of Alkylated Hydroxy Benzene

The alkylated hydroxy benzene sulfonic acid was prepared according to the procedures of Comparative Example A.

B. Neutralizafion of Sulfonated Alkyl Hydroxy Benzene 324 grams of alkyl hydroxy benzene sulfonic acids produced above were immediately neutralized in a stirred beaker containing 240 grams xylenes, 34 grams methanol, and 27.5 grams calcium hydroxide. Neutralization was completed by heating for half an hour at 100° F.

C. Neutralization of Acid Component 78.2 grams of stearic acid were dissolved in 200 grams of xylenes. A slurry of 100 grams xylenes, 44 grams methanol, and 41 grams $Ca(OH)_2$ was then added to neutralize the stearic acid and to provide an initial charge of $Ca(OH)_2$ for the carbonation step.

D. Overbasing

The slurry of neutralized alkyl hydroxy benzene sulfonic acid was added to the reactor containing the neutralized stearic acid and excess $Ca(OH)_2$ slurry. A slurry of 250 grams xylenes, 77 grams methanol, and 137 grams $Ca(OH)_2$ was then added and the resulting slurry heated to 90° F. 88.4 grams of carbon dioxide was charged to the reactor over 150 minutes. The initial rate of addition was 0.38 grams/minute, which was raised to 0.73 grams/minute after 5.2 grams of carbon dioxide were added. The rate of addition of the carbon dioxide was gradually reduced from 0.73 grams/minute to 0.25 grams/minute over the carbonation period. At 79% of the carbon dioxide charge, another slurry was added made up of 56 grams xylenes, 13 grams methanol, and 38 grams calcium hydroxide.

At the end of carbonation, the reactor was equipped with a condenser for stripping and the temperature was ramped to 200° F. over two hours. At 200° F., the temperature was ramped to 270° F. over 30 minutes. At 270° F., 215 grams of 100 Neutral oil was added and the entire batch was then filtered through a Buchner filter. The filtrate was then stripped to 400° F. at 40 mm Hg vacuum. The base number was then measured with a resulting number of 351. An additional 110.2 grams of 100 Neutral oil was added to adjust the base number to 300.

The final product had a viscosity of 89 cSt at 100° C. at a total base number of 300. It had 49.33% of the alkyl group of the sulfonate attached at the 4-position and higher positions of the alkyl groups.

EXAMPLE 2

Neutralize Alkyl Hydroxy Benzene Sulfonate Neutralized Stearic Acid

A. Sulfonation of Alkylated Hydroxy Benzene

The alkylated hydroxy benzene sulfonic acid was prepared according to the procedures of Comparative Example A.

B. Neutralization of Sulfonated Alkyl Hydroxy Benzene 239 grams of alkyl hydroxy benzene sulfonic acids produced above were immediately neutralized in a stirred beaker containing 179 grams xylenes, 25.5 grams methanol, and 20.5 grams calcium hydroxide. Neutralization was completed by heating for half an hour at 100° F.

C. Neutralization of Acid Component 60.5 grams of stearic acid were dissolved in 300 grams of xylenes. 3.7 grams methanol and 8.7 grams $Ca(OH)_2$ were then added to neutralize the stearic acid.

D. Overbasing 313 grams of the neutralized alkyl hydroxy benzene sulfonic acid was added to the reactor containing the neutralized stearic acid. A slurry of 172 grams xylenes, 60 grams methanol, and 75 grams $Ca(OH)_2$ was then added and the temperature of the resulting slurry was adjusted to 90° F. 123.8 grams of carbon dioxide was charged to the reactor over 208 minutes. The initial rate of addition was 0.45 grams/minute, which was raised to 0.70 grams/minute after 15.0 grams of carbon dioxide were added. The rate of addition of the carbon dioxide was gradually reduced from 0.70 grams/minute to 0.30 grams/minute over the carbonation period. At 6.0 grams of carbon dioxide, 151 grams of the neutralized alkyl hydroxy benzene sulfonic acid was added. At 12.0 grams of carbon dioxide, a slurry of 344 grams xylenes, 60 grams methanol, and 150 grams $Ca(OH)_2$ was added. At 99.0 grams of carbon dioxide, a slurry of 110 grams xylenes, 14 grams methanol, and 45 grams calcium hydroxide was added.

At the end of the carbonation, the reactor was equipped with a condenser for stripping and the temperature was ramped to 200° F. over two hours. At 200° F., the temperature was ramped to 270° F. over thirty minutes. At 270° F., 215 grams of 150 Neutral oil was added and the entire batch was then filtered through a Buchner filter. The filtrate was then stripped to 400° F. at 40 mm Hg vacuum. The base number was then measured with a resulting number of 462. An additional 92.4 grams of 150 Neutral oil was added to adjust the base number to 400.

The final product had a viscosity of 300 cSt at 100° C. at a total base number of 400. It had 49.33% of the alkyl groups of the sulfonate attached at the 4-position and higher positions of the alkyl groups.

EXAMPLE 3

Alkyl Hydroxy Benzene Sulfonate Stearic Acid

A. Sulfonation of Alkylated Hydroxy Benzene

The alkylated hydroxy benzene sulfonic acid is prepared according to the procedures of Comparative Example A.

B. Neutralization of Alkyl Hydroxy Benzene Sulfonic Acid and Stearic Acid 324 grams of alkyl hydroxy benzene sulfonic acid and 78.2 grams of stearic acid are immediately neutralized in a stirred reaction vessel containing 440 grams xylenes, 78 grams methanol, and 68.5 grams calcium hydroxide. Neutralization is completed by heating for half an hour at 100° F.

C. Overbasing

A slurry of 250 grams xylenes, 77 grams methanol, 137 grams calcium hydroxide is added to the reactor containing the neutralized alkyl hydroxy benzene sulfonic acid and neutralized stearic acid, and the resulting slurry is heated to 90° F. 88.4 grams of carbon dioxide is charged to the reactor over 150 minutes. The initial rate of addition is 0.38 grams/minute, which is raised to 0.73 grams/minute after 5.2 grams of carbon dioxide are added. The rate of addition of the carbon dioxide is gradually reduced from 0.73 grams/minute to 0.25 grams/minute over the carbonation period. At 79% of the carbon dioxide charge, another slurry made up of 56 grams xylenes, 13 grams methanol, and 38 grams calcium hydroxide is added.

At the end of the carbonation, the reactor is equipped with a condenser for stripping and the temperature is ramped to 200° F. over two hours. At 200° F., the temperature is ramped to 270° F. over 30 minutes. At 270° F., 215 grams of 100 Neutral oil is added and the entire batch is then filtered through a Buchner filter. The filtrate is then stripped to 400° F. at 40 mm Hg vacuum. The base number is then measured, and additional 100 Neutral oil is added to adjust the base number to 300.

EXAMPLE 4

Alkyl Hydroxy Benzene Sulfonate Stearic Acid

A. Sulfonation of Alkylated Hydroxy Benzene

The alkylated hydroxy benzene sulfonic acid is prepared according to the procedures of Comparative Example A.

B. Neutralization of Alkyl Hydroxy Benzene Sulfonic Acid and Stearic Acid 239 grams of alkyl hydroxy benzene sulfonic acids and 60.5 grams of stearic acid are immediately neutralized in a stirred reaction vessel containing 479 grams xylenes, 29.2 grams methanol, and 29.2 grams calcium hydroxide. Neutralization is completed by heating for half an hour at 100° F.

C. Overbasing

A slurry of 172 grams xylenes, 60 grams methanol, 75 grams calcium hydroxide is added to the reactor containing the neutralized alkyl hydroxy benzene sulfonic acid and neutralized stearic acid, and the resulting slurry is heated to 90° F. 123.8 grams of carbon dioxide is charged to the reactor over 208 minutes. The initial rate of addition was 0.45 grams/minute, which is raised to 0.70 grams/minute after 15.0 grams of carbon dioxide are added. The rate of addition of the carbon dioxide is gradually reduced from 0.70 grams/minute to 0.30 grams/minute over the carbonation period. At 12.0 grams of carbon dioxide, a slurry of 344 grams xylenes, 60 grams methanol, and 150 grams calcium hydroxide is added. At 99.0 grams of carbon dioxide, a slurry of 110 grams xylenes, 14 grams methanol, and 45 grams calcium hydroxide is added.

At the end of the carbonation, the reactor is equipped with a condenser for stripping and the temperature is ramped to 200° F. over two hours. At 200° F., the temperature is ramped to 270° F. over 30 minutes. At 270° F., 215 grams of 150 Neutral oil is added and the entire batch is then filtered through a Buchner filter. The filtrate is then stripped to 400° F. at 40 mm Hg vacuum. The base number is then measured and additional 150 Neutral oil is added to adjust the base number to 400.

Comparison To Other Metal-Containing Detergents

Results of experiments for comparing the overbased alkyl hydroxy benzene sulfonate-carboxylates of the invention with commercially available metal-containing detergents are shown below:

Oxidation stability

Test method: according to JIS K-2514

Tested detergents:

Ex. 1: 300 TBN Alkyl hydroxy benzene sulfonate-stearate

Ex. 2: 400 TBN Alkyl hydroxy benzene sulfonate-stearate

Comparative Ex. A: 300 TBN Alkyl hydroxy benzene sulfonate

Comparative Ex. B: Commercially available 400 TBN benzene sulfonate

Comparative Ex. C: Commercially available 400 TBN benzene sulfonate

Oil for test: TBN 33 in SAE #40

Test conditions: heated at 165.5° C. for 72 hours

The results are measures as a ratio of viscosity (40° C.) (Heated/Unheated)

Detergency at elevated temperature

Test method: Hot tube test

Oil for test: TBN 33 in SAE #40

Test conditions: 330° C., 16 hours

The results are measured as a Lacquer rating (10=Clear)

Thermal stability

Test method: Panel coker test

Oil for test: TBN 33 in SAE #40

Test conditions: 3 hours

The results are measured as milligrams of deposit.

Stability in Water

Test method: ASTM D-2619 (modified Coke bottle)

Oil for test: TBN 33 in SAE #40

Test conditions: 100 grams of the test oil (its TBN is previously determined) and 5 grams of distilled water are placed in a pressure-resistant bottle. The bottle is placed in an air thermostat at 93° C., for 24 hrs. under the condition that he bottle is rotated with upside down at 5 r.p.m., for hydrolyzing the test oil.

The TBN is then determined for the hydrolyzed test oil. The weight percent of petroleum ether insolubles is measured.

Comparison of Overbased Alkyl Hydroxy Benzene Sulfonate-Carboxylates to Overbased Alkyl Hydroxy Benzene Sulfonate Example 1 (300 TBN alkyl hydroxy benzene sulfonate-stearate) was compared to a 300 TBN alkyl hydroxy benzene sulfonate (Comparative Example A). The following table shows that Example 1 has superior detergency at elevated temperature, thermal stability, and stability in water at comparable oxidation stability.

| | Example 1 | Example A |
|---|---|---|
| Oxidation Stability | 1.07 | 1.06 |
| Detergency At Elevated Temperature | 6.5 | 5.5 |
| Thermal Stability | 100.5 | 179.3 |
| Stability in Water | 1.10 | 1.74 |

Comparison of Overbased Alkyl Hydroxy Benzene Sulfonate-Carboxylates to Overbased Alkyl Hydroxy Benzene Sulfonates Example 2 (400 TBN alkyl hydroxy benzene sulfonate-stearate) was compared to 400 TBN commercial benzene sulfonates (Comparative Examples B and C). The following table shows that Example 2 has superior detergency at elevated temperatures compared to commercial benzene sulfonates.

| Detergency At Elevated Temperature | Example 2 | Example B | Example C |
|---|---|---|---|
| at 300° C. | 8.0 | 0.0 | 9.5 |
| at 310° C. | 7.5 | 0.0 | 0.0 |

While the present invention has been described with reference to specific embodiments, this application is intended to cover those various changes and substitutions that may be made by those skilled in the art without departing from the spirit and scope of the appended claims.

What is claimed is:

1. An additive produced by reacting at elevated temperatures in the presence of at least one light hydrocarbon solvent and promoter:

(a) an alkyl oxy aromatic sulfonate, wherein the oxy is selected from the group consisting of hydroxy, methoxy, ethoxy, propoxy, butoxy, pentoxy, and hexoxy;

(b) an alkaline earth metal base;

(c) carbon dioxide; and (d) an acid component selected from the group consisting of a carboxylic acid, an acid anhydride, an acid choride, and ester thereof, said acid component having a molecular weight of less than 500 and having the following structure:

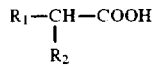

wherein $R_1$ is a $C_{10}$ to $C_{24}$ alkyl or alkenyl group; wherein $R_2$ is hydrogen, a $C_1$ to $C_4$ alkyl group, or a $CH_2COOH$ group; and wherein the acid component provides from 2 to 40 weight % of the additive, wherein:

(1) if the alkyl oxy aromatic sulfonate is in the acidic form, the acid component is in the acidic form;

(2) if the alkyl oxy aromatic sulfonate is in the neutralized form, the acid component is in the neutralized form; and (3) if the alkyl oxy aromatic sulfonate is in the overbased form, the acid component is either in the acidic form or in the neutralized form.

2. An additive according to claim 1 wherein both the alkyl oxy aromatic sulfonate and the acid component are in the acidic form.

3. An additive according to claim 1 wherein both the alkyl oxy aromatic sulfonate and the acid component are in the neutralized form.

4. An additive according to claim 1 wherein the alkyl oxy aromatic sulfonate is in the overbased form and the acid component is either in the acidic form or in the neutralized form.

5. An additive according to claim 1 wherein the alkyl group of the alkyl oxy aromatic sulfonate has from eighteen to thirty carbon atoms per alkyl group.

6. An additive according to claim 5 wherein the alkyl group of the alkyl oxy aromatic sulfonate has from twenty to twenty-four carbon atoms per alkyl group.

7. An additive according to claim 1 wherein between 40 and 80 weight % the alkyl groups of the alkyl oxy aromatic sulfonate are attached at the 4-position and higher positions of the alkyl groups.

8. An additive according to claim 1 wherein the oxy group is hydroxy.

9. An additive according to claim 1 wherein the aromatic group is benzene.

10. An additive according to claim 1 wherein the alkaline earth metal is calcium.

11. An additive according to claim 1 wherein the acid component is a carboxylic acid.

12. An additive according to claim 11 wherein the acid component is stearic acid.

13. An additive according to claim 1 wherein the acid component provides from 15 to 25 weight % of the sum of the acid component and alkyl oxy aromatic sulfonate.

14. An additive according to claim 1 wherein the alkaline earth metal is calcium and the base ratio of calcium carbonate to calcium sulfonate is from 5:1 to 30:1.

15. An additive according to claim 14 wherein the base ratio of calcium carbonate to calcium sulfonate is from 17:1 to 20:1.

16. An additive according to claim 1 wherein reaction occurs at atmospheric pressure.

17. An additive according to claim 1 wherein reaction occurs at temperatures of from 90° to 120° F.

18. An additive concentrate, having a TBN of at least 200, comprising:

(a) from 20 to 50 weight % a base oil of lubricating viscosity; and (b) from 50 to 80 weight % of the additive according to claim 1.

19. An additive concentrate according to claim 18 wherein the TBN of the additive concentrate is between 300 and 500.

20. A marine lubricating oil comprising:

(a) a major amount of a base oil of lubricating viscosity; and (b) a minor amount of the additive concentrate according to claim 18.

21. A marine lubricating oil according to claim 20, wherein the TBN of the additive concentrate is between 300 and 500.

22. A process for the production of a lubricating oil additive, which comprises reacting at atmospheric pressure and temperatures of from 90° to 120° F. in the presence of at least one light hydrocarbon solvent and promoter:

(a) an alkyl hydroxy benzene sulfonate in the acidic form, wherein the alkyl group has from twenty to twenty-four carbon atoms per alkyl group;

(b) calcium base;

(c) carbon dioxide; and (d) stearic acid, wherein the stearic acid provides from 15 to 25 weight % of the sum of the acid component and alkyl hydroxy benzene sulfonate, and the base ratio of calcium carbonate to calcium sulfonate is from 17:1 to 20:1.

23. A process for the production of a lubricating oil additive, which comprises reacting at atmospheric pressure and temperatures of from 90° to 120° F. in the presence of at least one light hydrocarbon solvent and promoter:

(a) a neutralized alkyl hydroxy benzene sulfonate, wherein the alkyl group has from twenty to twenty-four carbon atoms per alkyl group;

(b) calcium base;

(c) carbon dioxide; and (d) stearic acid in the neutralized form, wherein the stearic acid provides from 15 to 25 weight % of the sum of the acid component and alkyl hydroxy benzene sulfonate, and the base ratio of calcium carbonate to calcium sulfonate is from 17:1 to 20:1.

24. A process for the production of a lubricating oil additive, which comprises reacting at atmospheric pressure and temperatures of from 90° to 120° F. in the presence of at least one light hydrocarbon solvent and promoter:

(a) an overbased alkyl hydroxy benzene sulfonate, wherein the alkyl group has from twenty to twenty-four carbon atoms per alkyl group;

(b) calcium base;

(c) carbon dioxide; and (d) stearic acid in either the acidic form or the neutralized form, wherein the stearic acid provides from 15 to 25 weight % of the sum of the acid component and alkyl hydroxy benzene sulfonate, and the base ratio of calcium carbonate to calcium sulfonate is from 17:1 to 20:1.

* * * * *